United States Patent [19]

Schluep

[11] 3,942,317

[45] Mar. 9, 1976

[54] COMPONENT PARTS FOR WATCH MOVEMENTS

[75] Inventor: Jean-Pierre Schluep, Evilard, Switzerland

[73] Assignee: Ebauches Bettlach S.A., Bettlach, Switzerland

[22] Filed: Dec. 3, 1974

[21] Appl. No.: 529,060

[52] U.S. Cl. ..... 58/59; 58/82 R; 58/107; 106/290

[51] Int. Cl.[2] G04B 33/00; G04B 5/02; G04B 17/00; G04B 31/18

[58] Field of Search ..... 58/116 R, 59, 107, 82 R; 106/290

[56] References Cited

UNITED STATES PATENTS

| | | | |
|---|---|---|---|
| 2,894,367 | 7/1959 | Gingrich | 58/107 X |
| 2,947,646 | 8/1960 | Devaney et al. | 106/290 X |
| 3,503,882 | 3/1970 | Fitch | 106/290 X |
| 3,803,830 | 4/1974 | Lawson | 58/116 R |

*Primary Examiner*—George H. Miller, Jr.
*Attorney, Agent, or Firm*—Stevens, Davis, Miller & Mosher

[57] ABSTRACT

Component parts for watch movements which consist of a plastic body shaped by molding with heavy metal particles dispersed throughout to produce a component part having a specific gravity of more than 7.

10 Claims, 4 Drawing Figures

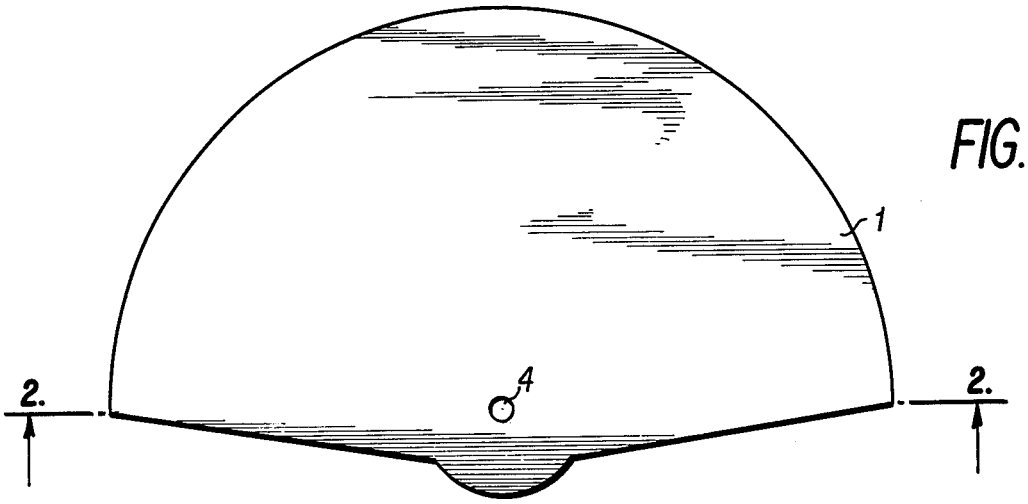
FIG. 1
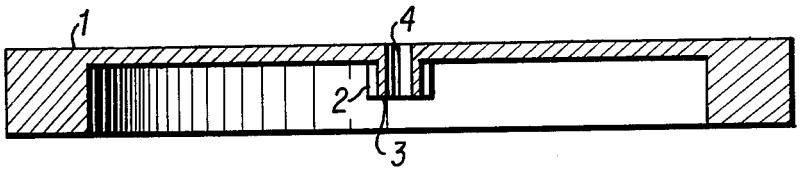
FIG. 2
FIG. 3
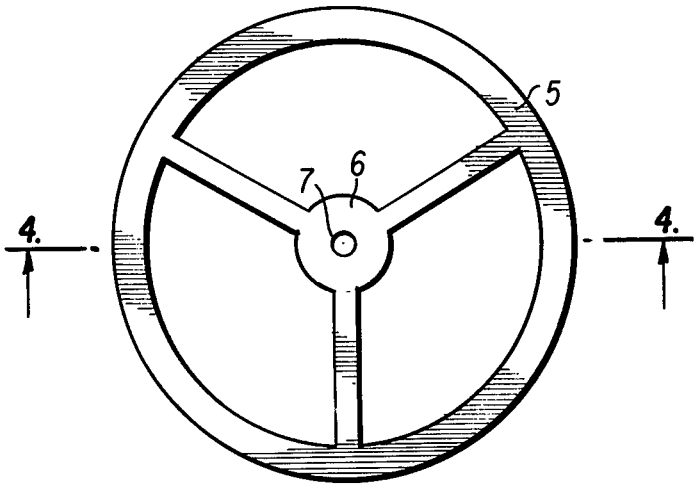
FIG. 4
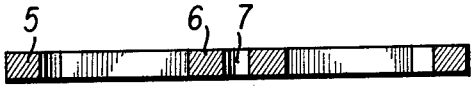

COMPONENT PARTS FOR WATCH MOVEMENTS

This invention relates to component parts, having a specific gravity of more than 7, for watch movements.

Processes for molding plastics or thermosetting synthetic resins are known to be advantageous in the manufacture of component parts for watch movements in that they make it possible to obtain parts of various, sometimes very complicated shapes, needing no correction, for they leave the molding operation ready for use.

However, since the plastics which can be utilized for such applications are light, i.e., their specific gravity is in the neighborhood of 1 and amounts, for example, to 1.05 for the most commonly used materials, such processes are not applicable to component parts which, owing to their functions, must be relatively heavy, such as winding weights or balances.

Self-lubricating bearings have already been made from a plastic loaded with particles of bronze, but the quantity of metal incorporated in these bearings was such that their average specific gravity did not exceed about 3. Moreover, these parts were of a very simple geometric form. Until now, high-inertia parts such as balances or winding weights intended for watch movements have always been produced by machining methods, with or without removal of chips, by casting of heavy metals, or by sintering. However, all these methods involve finishing operations, so that the cost of the parts is relatively high. In certain cases, such components have hitherto been manufactured in several parts, and this has necessitated assembly operations as well.

It is therefore the object of this invention to reduce the cost price of component parts for watch movements which, owing to their functions, must have considerable mass, and the average specific gravity of which is consequently more than 7.

To this end, the component parts according to the present invention each consist of a plastic body shaped solely by molding and of a load of particles of a heavy metal dispersed throughout that body.

The watch movement components according to this invention will preferably be either winding weights, particularly winding weights made in one piece with a pinion and a hub, or else balances intended to be mounted on a staff.

With the aid of several examples and accompanying drawing figures illustrating the production of component parts for watch movements according to the present invention, it will now be explained how the invention can be carried out.

FIG. 1 shows a plan view of a winding weight;

FIG. 2 is a cross-sectional view of the winding weight taken along line II—II of FIG. 1;

FIG. 3 is a plan view of a balance wheel; and

FIG. 4 is a cross-sectional view of the balance wheel taken along line IV—IV of FIG. 3.

It was found first of all that it was possible to mold plastic parts comprising a load of heavy metal particles such that the average specific gravity of the parts was more than 7. To manufacture such a part, the first step is to produce plastic granules or pellets by extrusion in an extrusion machine. The raw material is fed into the extrusion machine together with the loading metal. The plastic material is in the usual form, while the loading material is charged in the form of powder or of granules varying from about 5 microns to 200 microns in size. The respective proportions of plastic and metal are adjusted at the opening into the extrusion machine. This machine then proceeds, in the known manner, to mix the materials fed into it, to heat the plastic until it reaches the plasticized state, and finally to extrude the mixture under pressure in the form of a continuous bar which is cut up so as to yield the pellets or granules which can be used for the following operation. It has been found that in an extruder of this type, it is possible to form pellets of plastic loaded with metal in which the proportion of heavy metal amounts to 20–80% by volume. Preferably, a compound comprising about 50% by volume of heavy metal will be produced. The metal may be any heavy metal capable of being reduced to powder or to granules of the aforementioned size; however, it is possible to obtain particularly favorable results with tungsten owing to its very high specific gravity. The tungsten must be relatively pure and contain no alloy elements. It has been found indispensable to have a purity of at least 99%. In particular, traces of carbon are to be avoided as far as possible.

By way of example, a charge intended for a molding machine was prepared in the following manner: 112 g. of "Rilsan"—brand thermoplastic material in natural powder form and 2 kg. of powdered tungsten are mixed for 2 min. in a "Henschel"—brand mixer rotating at a speed of 900 rpm. The mixture is vacuum-dried at 80° C., then poured into an extruder, e.g., a screw-type extruder without filter, turning at a speed of 20/25 rpm. The mixing and extrusion operations may likewise be carried out with other types of machines. The conversion temperatures may be adjusted to the following values: 165°, 185°, 205°, and 200° C. The cooling vat is situated immediately after the extrusion die. The bar leaving the extruder is then broken up into pellets as mentioned above.

The pellets thus prepared may serve to feed the hopper of a conventional molding installation capable of heating the plastic and its metal load until the plastic melts, then pressing it through the distribution ducts into the mold intended to form the desired components. It has been found that this injection operation can take place under normal conditions as concerns the temperature and pressure.

Components having an average specific gravity of 10 and even 12 can be produced by the foregoing method. Molded parts of a complicated shape can be produced in a single shaping operation and need no correcting or finishing operation.

Various kinds of components used in the manufacture of watch movements may be produced in this manner. In particular, it is possible to produce winding weights for automatic watch movements as shown in FIGS. 1 and 2. These components may comprise, in one piece, the oscillating sector 1, the pinion 2 for transmitting oscillating movements to the winding-train, and the hub 3 provided with a cylindrical bore 4 for the pivoting of the winding weight.

In another embodiment, however, the molded plastic component having a load of metal particles might comprise only the oscillating sector proper, the flat surface of this sector being provided with a square hole in which the arbor of the pinion of the oscillating weight would be engaged, held in place by a screw.

In still another embodiment shown in FIGS. 3 and 4, the component part of a watch movement according to the invention might be the wheel 5 of a balance. In this case, the hub 6 of the balance would be provided, for example, with a square or cylindrical hole 7 intended to be engaged or driven onto a square or cylindrical bearing surface of the balance-staff. The staff would then be made of metal.

As will be seen, the process described above makes it possible to produce, with a quite common and conventional technique, watch movement components which must have both great inertia and compact dimensions, taking advantage at the same time of the ease and convenience offered by plastic molding technology.

Besides tungsten, the specific gravity of which is about 19 grams per cubic centimeter, the following metals may also be used: gold, having practically the same specific gravity as tungsten, or tantalum, the specific gravity of which is on the order of 16 grams per cubic centimeter. Silver and molybdenum might also enter into consideration, as well as nickel, although their specific gravity is less. Moreover, several metals which are appreciably heavier than tungsten might also be considered to the extent that they are not prohibitive in cost.

As for the plastics which may be used for manufacturing the component parts described, they comprise most of the usual plastics, and especially both thermoplastic materials and thermosetting resins.

What is claimed is:

1. A component part for watch movements, consisting of a plastic body shaped solely by molding, with particles of a heavy metal dispersed throughout said body, said part having an average specific gravity of more than 8.

2. A component part in accordance with claim 1, having an average specific gravity of more than 10.

3. A component part in accordance with claim 2, having an average specific gravity substantially equal to 12.

4. A component part in accordance with claim 1, containing from 20% to 80% by volume of said particles.

5. A component part in accordance with claim 4, containing about 50% by volume of said particles.

6. A component part in accordance with claim 1, wherein said heavy metal is selected from the group consisting of tungsten, gold, tantalum, silver, molybdenum, and nickel.

7. A component in accordance with claim 6, wherein said heavy metal is tungsten.

8. Parts in accordance with claim 7, wherein the size of said particles is between about 5 microns and 200 microns.

9. Component parts for a watch movement comprising a one-piece winding weight for automatically winding said movement, said winding weight comprising an oscillating sector portion, a pinion portion, and a hub portion with a cylindrical bore therein, said winding weight further consisting of a plastic body and of a load of particles of a heavy metal dispersed throughout said body, said weight being shaped solely by molding and having a specific gravity of more than 8.

10. Component parts for a watch movement comprising a balance wheel in one piece with a hub provided with a cylindrical hole intended to be engaged onto a cylindrical surface of a balance-staff, said one piece being shaped solely by molding and consisting of a plastic body and of a load of particles of a heavy metal dispersed throughout said body in such a manner that the specific gravity of said one piece be more than 8.

* * * * *